US009293875B2

(12) United States Patent
Tada et al.

(10) Patent No.: US 9,293,875 B2
(45) Date of Patent: Mar. 22, 2016

(54) RECEPTACLE AND PLUG

(71) Applicant: JAPAN AVIATION ELECTRONICS INDUSTRY, LIMITED, Shibuya-ku, Tokyo (JP)

(72) Inventors: Takashi Tada, Tokyo (JP); Akihiro Matsunaga, Tokyo (JP); Masayuki Nishikata, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/230,910

(22) Filed: Mar. 31, 2014

(65) Prior Publication Data

US 2014/0302710 A1 Oct. 9, 2014

(30) Foreign Application Priority Data

Apr. 8, 2013 (JP) ..... 2013-080494

(51) Int. Cl.
*H01R 24/00* (2011.01)
*H01R 27/00* (2006.01)
(Continued)

(52) U.S. Cl.
CPC ..... *H01R 27/00* (2013.01); *H01R 13/6275* (2013.01); *H01R 24/62* (2013.01)

(58) Field of Classification Search
CPC ..... H01R 43/24; H01R 13/6275; H01R 13/5213; H01R 23/7072
USPC ..... 439/660, 353, 607.35, 607.4, 607.36
See application file for complete search history.

(56) References Cited

U.S. PATENT DOCUMENTS 7,033,218 B2 * 4/2006 Huang ..... H01T 13/6275 439/353
7,134,900 B2 * 11/2006 Chung ..... H01T 13/6275 439/353

(Continued)

FOREIGN PATENT DOCUMENTS

CN 202772376 U 3/2013
EP 2416455 A1 2/2012

(Continued)

OTHER PUBLICATIONS

Extended European Search Report dated Jul. 3, 2014 in counterpart European Application No. 14159264.2.

(Continued)

*Primary Examiner* — Hien Vu
(74) *Attorney, Agent, or Firm* — Holtz, Holtz & Volek PC

(57) ABSTRACT

A receptacle is selectively mateable with a first plug and a second plug. The receptacle comprises a holding member having a plate-like portion, a plurality of first contacts and a plurality of second contacts. The first contacts and the second contacts are held by the holding member. Each of the first contacts has a first contact portion while each of the second contacts has a second contact portion. The first contact portions and the second contact portions are exposed on a lower surface of the plate-like portion. The second contact portions are grouped into two groups. The first contact portions are located between the two groups of the second contact portions in a lateral direction. The first contact portions are connectable with both the first plug and the second plug, while the second contact portions are connectable with only the second plug between the first plug and the second plug.

10 Claims, 12 Drawing Sheets

(51) Int. Cl.
*H01R 13/627* (2006.01)
*H01R 24/62* (2011.01)

(56) References Cited

U.S. PATENT DOCUMENTS

| | | | | |
|---|---|---|---|---|
| 7,318,752 | B2 | 1/2008 | Fujimoto et al. | |
| 7,351,103 | B1 * | 4/2008 | Peng | H01R 13/6275 439/595 |
| 7,537,483 | B2 * | 5/2009 | Lin | H01R 13/6275 439/607.01 |
| 7,713,093 | B2 | 5/2010 | Kim | |
| 8,277,253 | B2 | 10/2012 | Lee et al. | |
| 8,794,992 | B2 * | 8/2014 | Hsu | H01R 13/5213 439/353 |
| 2008/0242149 | A1 | 10/2008 | Konno et al. | |
| 2011/0097932 | A1 | 4/2011 | Aihara et al. | |
| 2012/0034803 | A1 | 2/2012 | Sasaki et al. | |
| 2012/0231673 | A1 | 9/2012 | Hayashi et al. | |
| 2014/0065889 | A1 * | 3/2014 | Zhang | H01T 43/24 439/660 |

FOREIGN PATENT DOCUMENTS

| | | | |
|---|---|---|---|
| JP | 2005-317503 | A | 11/2005 |
| JP | 2007-059351 | A | 3/2007 |
| JP | 2008-301492 | A | 12/2008 |
| JP | 2009-289618 | A | 12/2009 |
| JP | 2010-092742 | A | 4/2010 |
| JP | 2012-043783 | A | 3/2012 |
| JP | 2012-069353 | A | 4/2012 |
| JP | 2012-190614 | A | 10/2012 |
| WO | 9820765 | A1 | 5/1998 |

OTHER PUBLICATIONS

European Office Action dated Apr. 1, 2015 issued in counterpart European Application No. 14 159 264.2.

European Office Action dated Aug. 31, 2015, issued in counterpart European Application No. 14159264.2.

Chinese Office Action (and English translation thereof) dated Oct. 29, 2015, issued in counterpart Chinese Application No. 201410119125.6.

* cited by examiner

RECEPTACLE AND PLUG

CROSS REFERENCE TO RELATED APPLICATIONS

An applicant claims priority under 35 U.S.C. §119 of Japanese Patent Application No. JP2013-080494 filed Apr. 8, 2013.

BACKGROUND OF THE INVENTION

This invention relates to a receptacle mateable with at least two different types of plugs and relates to a special plug mateable with this receptacle.

For example, this type of receptacle is disclosed in JP-A 2008-301492 (Patent Document 1), the content of which is incorporated herein by reference.

As shown in FIGS. 20 and 21, the receptacle of Patent Document 1 has a plurality of first contacts insert-molded in a holding member and a plurality of second contacts press-fit in the holding member. The first contacts are compliant with a universal serial bus (USB) standard. The first contact does not have a spring property, while the second contact has a spring property. In detail, each of the first contacts has an unmovable contact portion, while each of the second contacts has a contact portion that is movable up and down because of the resiliency of the second contact. The contact portions of the first contacts are arranged in a lateral direction. The contact portions of the second contacts are located under and behind the contact portions of the first contacts to be arranged in the lateral direction.

The receptacle of Patent Document 1 has a limit on reducing its size in an up-down direction because of its positional relation between the contact portions of the first contacts and the contact portions of the second contacts.

SUMMARY OF THE INVENTION

It is therefore an object of the present invention to provide a receptacle that is mateable with at least two different types of plugs and that can be further reduced in size. Moreover, it is another object of the present invention to provide a plug that has a structure preferable to reduce the size of this type of the receptacle.

A first aspect of the present invention provides a receptacle selectively mateable with one of a first plug and a second plug. The receptacle comprises a holding member, a plurality of first contacts and a plurality of second contacts. The holding member has a rear portion and a plate-like portion. The plate-like portion extends forward in a front-rear direction from the rear portion. The plate-like portion has a lower surface in an up-down direction perpendicular to the front-rear direction. Each of the first contacts has a first held portion and a first extending portion. The first held portions are held by the rear portion. The first extending portions extend forward from the first held portions; respectively. Each of the first extending portions is provided with a first contact portion. The first contact portions are exposed on the lower surface to be contactable. The first contact portions are connectable with both the first plug and the second plug. Each of the second contacts has a second held portion and a second extending portion. The second held portions are held by the rear portion. The second extending portions extend forward from the second held portions, respectively. Each of the second extending portions is provided with a second contact portion. The second contact portions are exposed on the lower surface to be contactable. The second contact portions are connectable with only the second plug between the first plug and the second plug. The first contact portions are located forward of the second contact portions. The second contact portions are grouped into two groups between which the first contact portions are located in a lateral direction perpendicular to both the front-rear direction and the up-down direction.

A second aspect of the present invention provides a plug mateable, as the second plug, with the receptacle of the first aspect. The plug has a plug mating end that is received in the receptacle under a mated state where the plug is mated with the receptacle. The plug comprises a plug holding-member, a plurality of first plug-contacts and a plurality of second plug-contacts. The plug holding-member holds the first plug-contacts and the second plug-contacts. Each of the first plug-contacts has a first plug-contact-portion. The first plug-contact-portions are brought into contact with the first contact portions of the first contacts, respectively, under the mated state. Each of the second plug-contacts has a second plug-contact-portion. The second plug-contact-portions are brought into contact with the second contact portions of the second contacts, respectively, under the mated state. In the front-rear direction, a distance between the first plug-contact-portion and the plug mating end is longer than another distance between the second plug-contact-portion and the plug mating end. The second plug-contacts are grouped into two groups. In the lateral direction, the first plug-contact-portions are located between the second plug-contact-portions of the second plug-contacts of one of the two groups and the second plug-contact-portions of the second plug-contacts of a remaining one of the two groups.

As described above, the first contact portions of the first contacts are located forward of the second contact portions of the second contacts. Moreover, the first contact portions are located between the two groups of the second contact portions in the lateral direction. Thus, unlike the receptacle of Patent Document 1, a section for the first contacts and another section for the second contacts of the present invention do not overlap each other in the up-down direction. According to the present invention, the size of the receptacle in the up-down direction can be reduced.

The receptacle of Patent Document 1 has the limit on reducing its size in the front-rear direction because of necessity of providing the spring property for the contact that is located rearward, or the second contact. In contrast, for example, when the extending portion of the second contact is not provided with the spring property, a size of the receptacle in the front-rear direction can be reduced.

An appreciation of the objectives of the present invention and a more complete understanding of its structure may be had by studying the following description of the preferred embodiment and by referring to the accompanying drawings.

Figure 1:
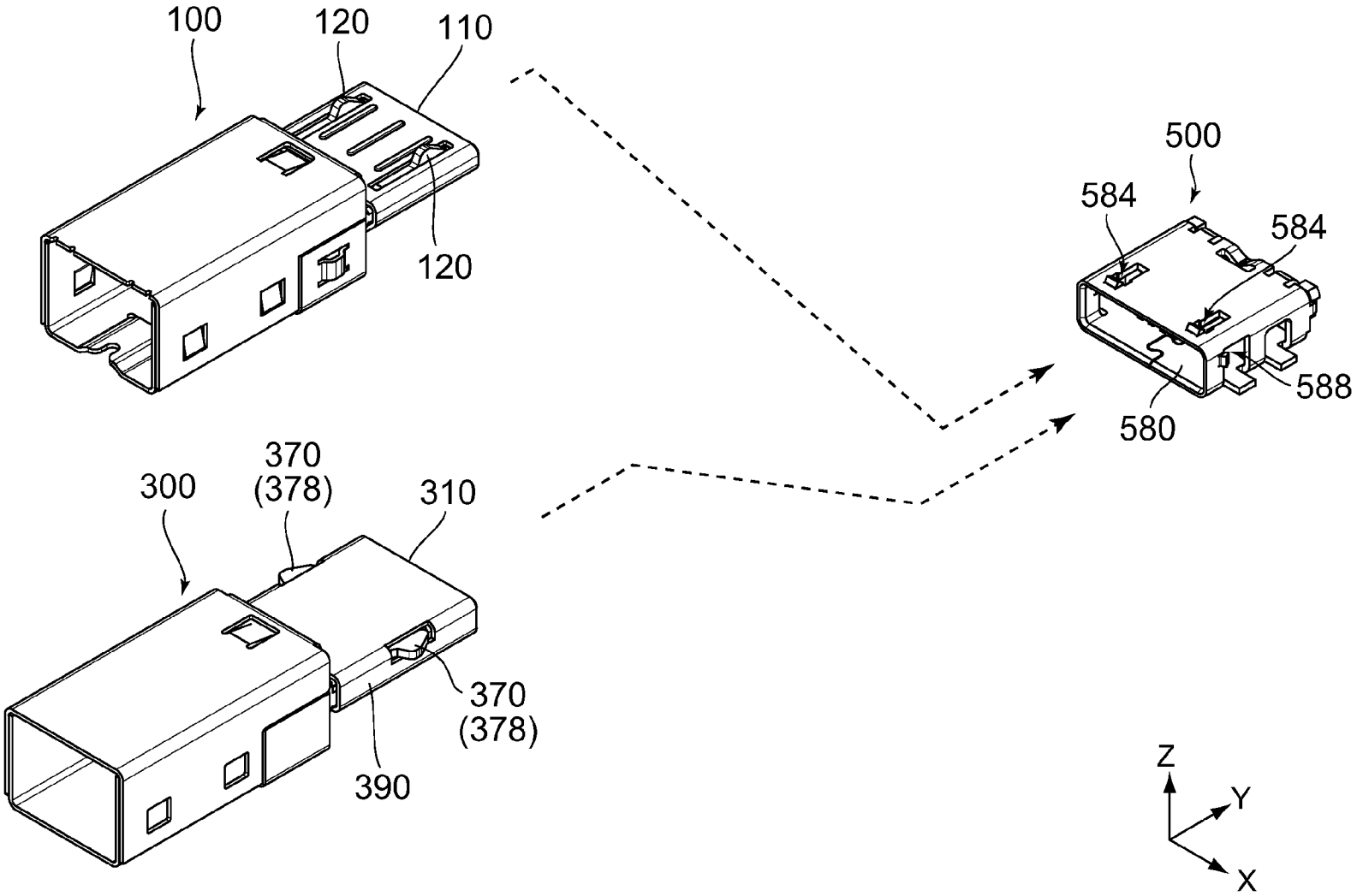
FIG. 1 is a perspective view showing a receptacle, a first plug and a second plug (plug) according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
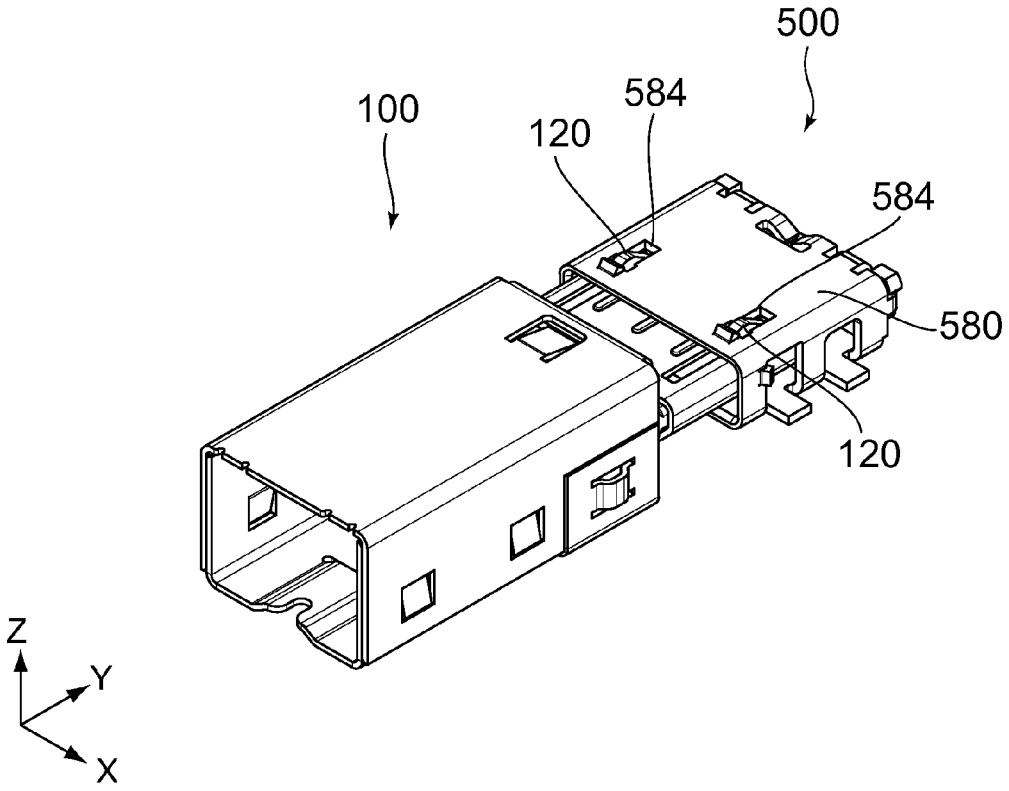
FIG. 2 is a perspective view showing the receptacle and the first plug of FIG. 1, wherein the receptacle and the first plug are in a mated state.
Figure 3:
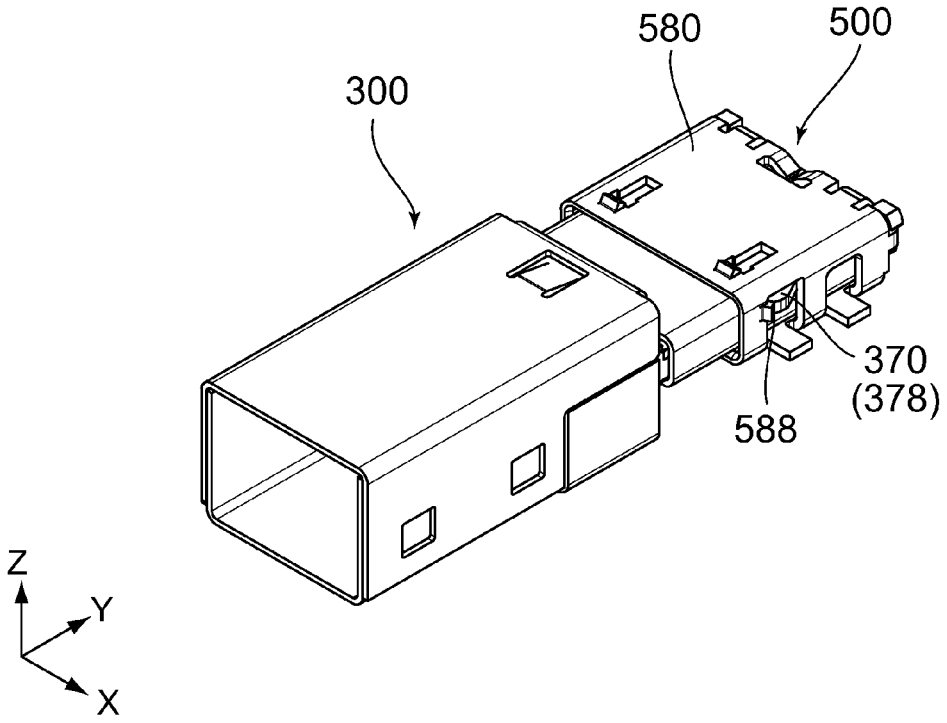
FIG. 3 is a perspective view showing the receptacle and the second plug of FIG. 1, wherein the receptacle and the second plug are in another mated state.

As shown in FIG. 1, a receptacle 500 according to an embodiment of the present invention is a connector selectively mateable with a first plug 100 and a second plug 300 along the Y-direction (front-rear direction). The receptacle 500 according to the present embodiment is mateable with the first plug 100, as shown in FIG. 2, and is mateable with the second plug 300, as shown in FIG. 3. Hereafter, a direction will be described based on the receptacle 500. Specifically, the negative Y-side is the front side while the positive Y-side is the rear side. In addition, the positive Z-side is the upper side while the negative Z-side is the lower side.

The first plug 100 according to the present embodiment is a connector compliant with a universal serial bus (USB) 2.0 standard. The first plug 100 has an end 110 and a first lock portion 120. The first lock portion 120 protrudes in the positive Z-direction and is movable along the Z-direction. The first lock portion 120 according to the present embodiment is also compliant with the USB 2.0 standard. Explanation about contacts and so on of the first plug 100 will be made below in conjunction with explanation about the second plug 300.

The second plug 300 according to the present embodiment is a connector different from the first plug 100. More specifically, the second plug 300 has an interface formed by modifying an interface of the first plug 100 to include a plurality of contacts in addition to the contacts of the first plug 100. The interface of the second plug 300 includes an interface related to signal transmission of the first plug 100.

Figure 4:
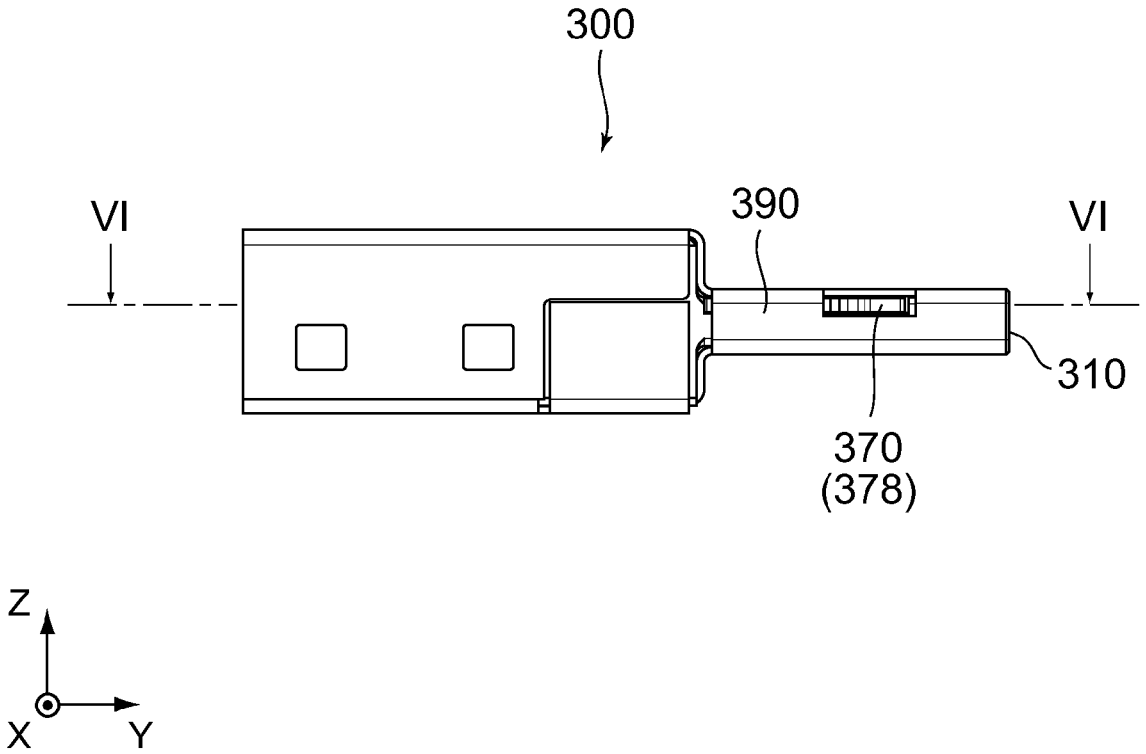
FIG. 4 is a side view showing the second plug of FIG. 1.
Figure 5:
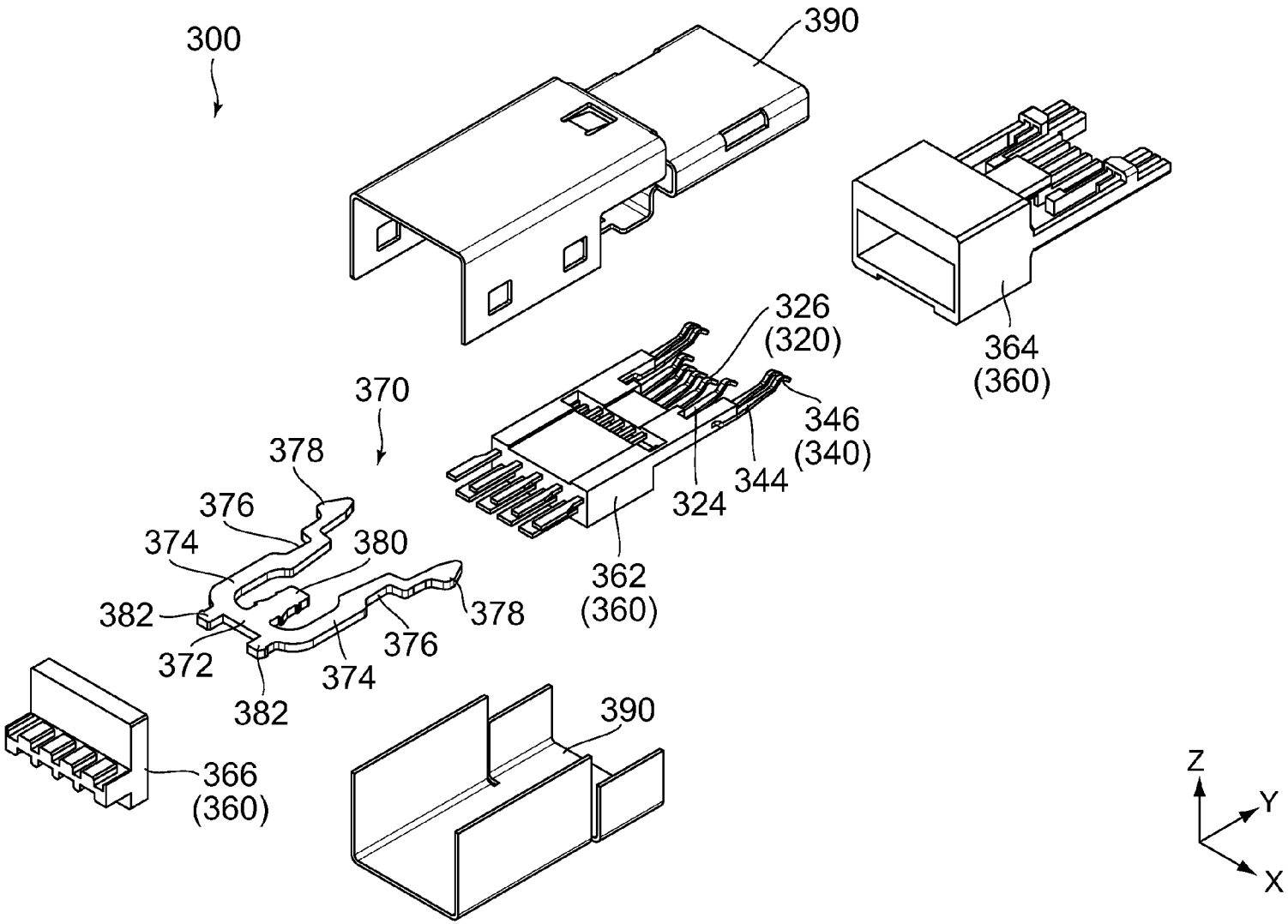
FIG. 5 is an exploded, perspective view showing the second plug of FIG. 4.
Figure 6:
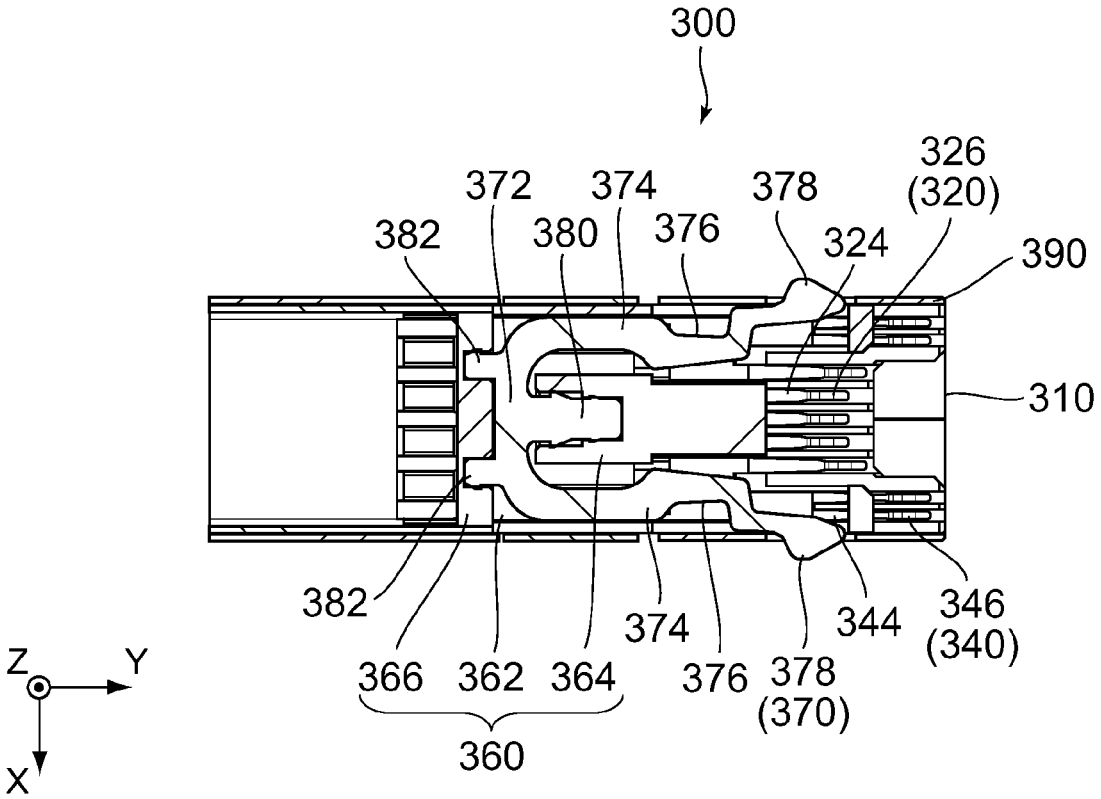
FIG. 6 is a cross-sectional view showing the second plug of FIG. 4, taken along line VI-VI.

As shown in FIGS. 4 to 6, the second plug 300 has a plug mating end 310. The plug mating end 310 is received in the receptacle 500 under a mated state where the second plug 300 is mated with the receptacle 500. The second plug 300 comprises a plurality of first plug-contacts 320 each made of a conductor, a plurality of second plug-contacts 340 each made of a conductor, a plug holding-member 360 made of an insulator, a lock member 370 made of a metal and a plug shell 390 made of a metal.

Figure 7:
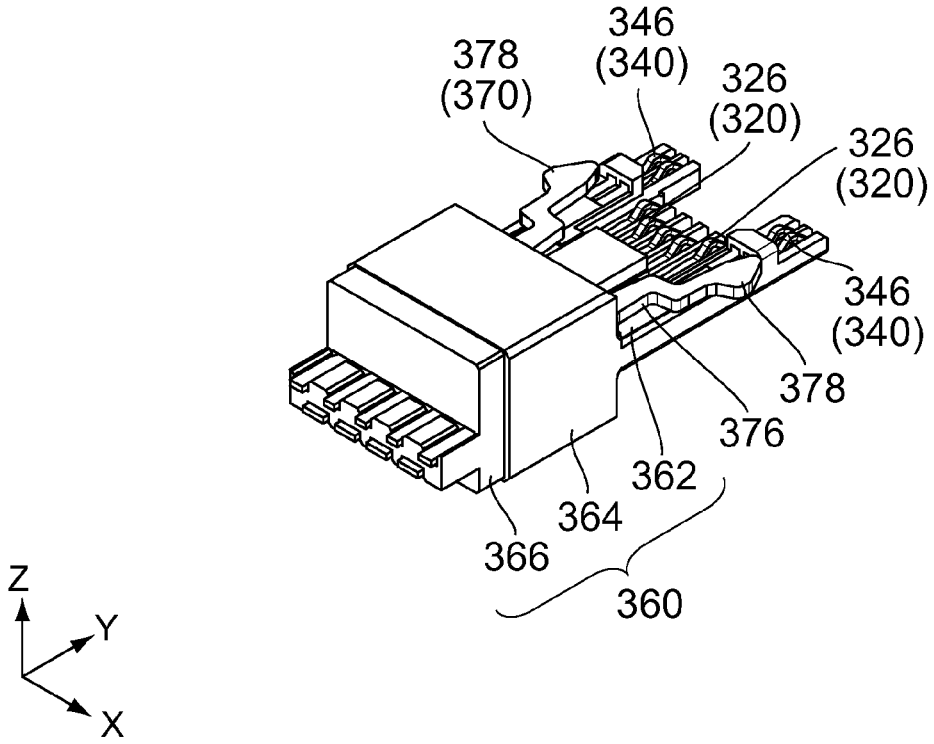
FIG. 7 is a perspective view showing the second plug of FIG. 4 without its shell.
Figure 8:
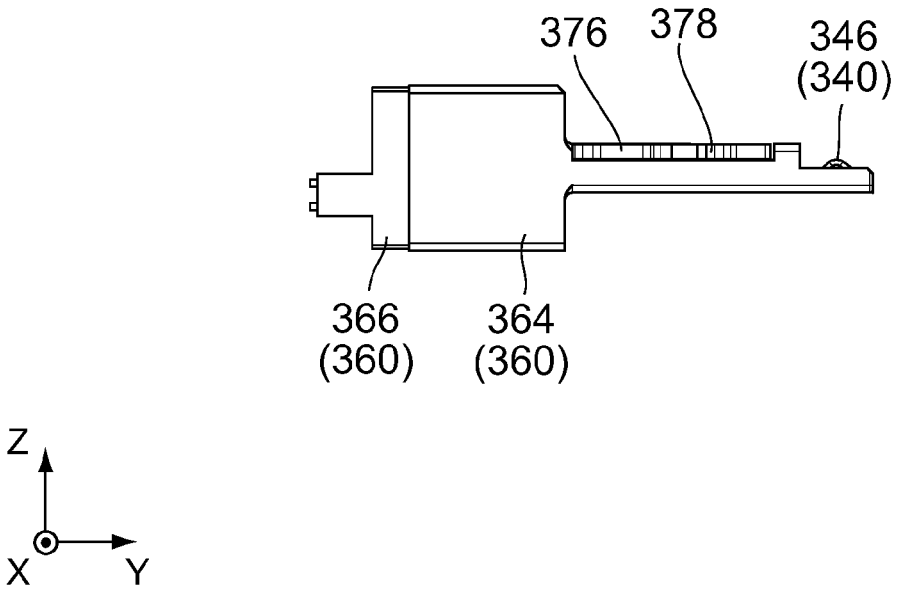
FIG. 8 is a side view showing the second plug of FIG. 7.
Figure 9:
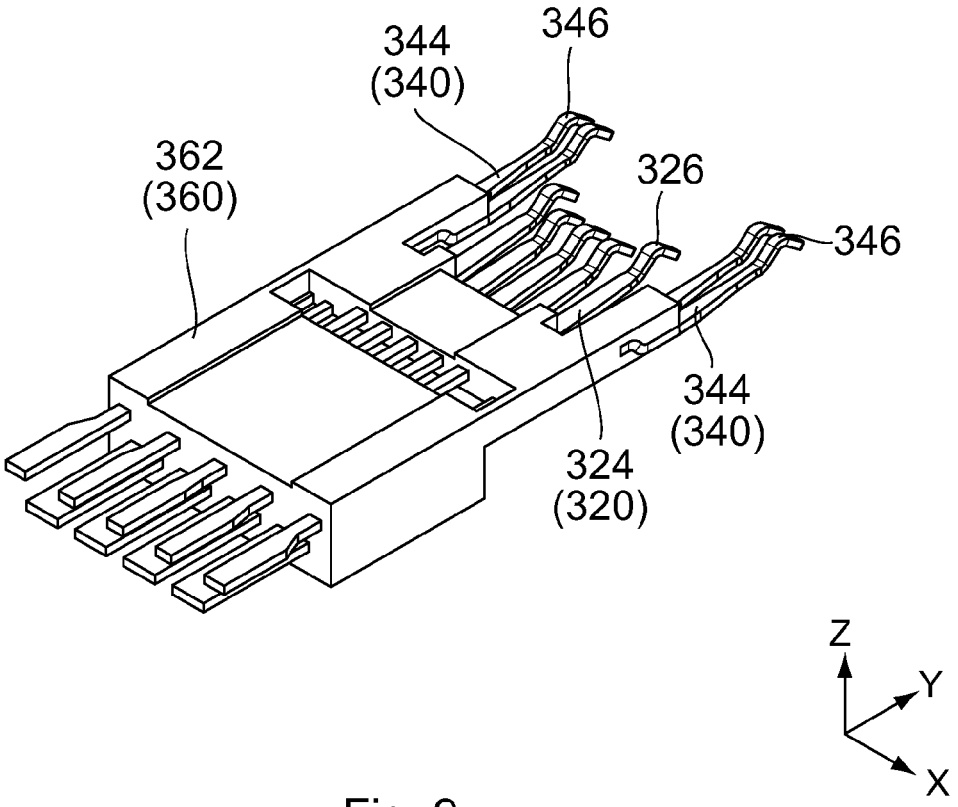
FIG. 9 is a perspective view showing an insert-molding member of the second plug of FIG. 5, wherein the insert-molding member is embedded with first plug-contacts and second plug-contacts.
Figure 10:
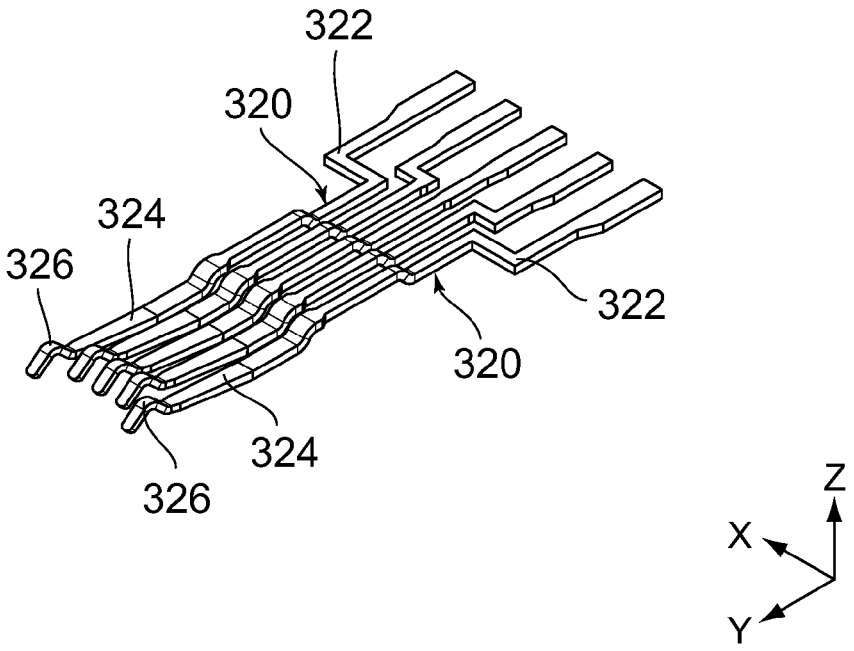
FIG. 10 is a perspective view showing the first plug-contacts of FIG. 9.

As shown in FIG. 7, the first plug-contacts 320 are held by the plug holding-member 360. Because the first plug-contacts 320 according to the present embodiment are compliant with the USB 2.0 standard, the number of the first plug-contacts 320 is five. As shown in FIG. 10, each of the first plug-contacts 320 has a held portion 322, a spring portion 324 and a first plug-contact-portion 326. The held portions 322 are held by the plug holding-member 360. Each of the spring portions 324 is resiliently deformable. The first plug-contact-portions 326 are supported by the spring portions 324, respectively. The first plug 100 is also provided with contacts corresponding to the first plug-contacts 320.

Figure 11:
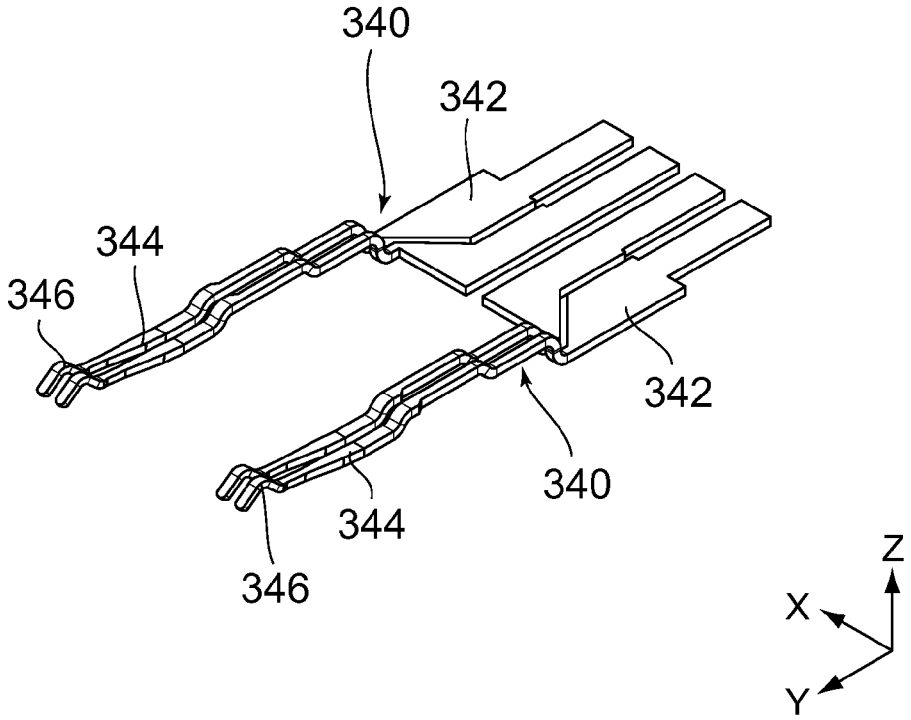
FIG. 11 is a perspective view showing the second plug-contacts of FIG. 9.

As shown in FIG. 7, the second plug-contacts 340 are also held by the plug holding-member 360. As shown in FIG. 11, each of the second plug-contacts 340 has a held portion (wide portion) 342, a spring portion 344 and a second plug-contact-portion 346. The held portions 342 are held by the plug holding-member 360. Each of the spring portions 344 is resiliently deformable. The second plug-contact-portions 346 are supported by the spring portions 344, respectively.

As can be seen from FIG. 11, the second plug-contacts 340 are divided into sets, each of which includes two of the second plug-contacts 340. In other words, the second plug-contacts 340 are grouped into two groups (sets). In the present embodiment, the second plug-contacts 340 of each group (set) form a pair of contacts for transmitting differential signals.

In the present embodiment, a width of the held portion 342 is equal to or more than twice of another width of the second plug-contact-portion 346. In other words, in the X-direction (lateral direction), the held portion 342 has a size equal to or more than twice of that of the second plug-contact-portion 346. This wide held portion 342 is provided in order to match its impedance with a mating contact, or a second contact 530, which is described later. Since the second plug-contacts 340 according to the present embodiment have the thus-configured held portions 342, respectively, the second plug-contacts 340 can be used for high speed signal transmission which satisfies a USB 3.0 specification.

As best shown in FIG. 6, the first plug-contact-portions 326 are located away from the plug mating end 310, which is an end of the second plug 300, in the Y-direction (front-rear direction) in comparison with the second plug-contact-portions 346. In other words, the first plug-contact-portions 326 are nearer to the negative Y-side end of the second plug 300 than the second plug-contact-portions 346. In the Y-direction, a distance between the first plug-contact-portion 326 and the plug mating end 310 is longer than another distance between the second plug-contact-portion 346 and the plug mating end 310.

As shown in FIG. 7, the first plug-contact-portions 326 and the second plug-contact-portions 346 are arranged in the X-direction (lateral direction) so that the second plug-contact-portions 346 of the second plug-contacts 340 of one of the groups, the first plug-contact-portions 326 and the second plug-contact-portions 346 of the second plug-contacts 340 of a remaining one of the groups are arranged in this order. In other words, in the X-direction, the first plug-contact-portions 326 are located between the two groups of the second plug-contact-portions 346 of the second plug-contacts 340.

As can be seen from FIGS. 5 to 7, the plug holding-member 360 according to the present embodiment includes an insert-molding member 362, an outer member 364 and a cover member 366. The insert-molding member 362 holds the first plug-contacts 320 and the second plug-contacts 340. More specifically, the held portions 322 of the first plug-contacts 320 and the held portions 342 of the second plug-contacts 340 are embedded into the insert-molding member 362 via insert-molding when the insert-molding member 362 is molded so that the held portions 322 and the held portions 342 are held by the insert-molding member 362. The first plug-contact-portions 326 and the second plug-contact-portions 346 are arranged in the aforementioned arrangement by this holding. The outer member 364 is a member which is attached to the outside of the insert-molding member 362. The cover member 366 covers the negative Y-side end, or an end opposite to the plug mating end 310 in the Y-direction (front-rear direction), of each of the insert-molding member 362 and the outer member 364. Although the plug holding-member 360 according to the present embodiment consists of the three members as described above, the present invention is not limited thereto. The plug holding-member 360 may consist of a single member, two members, four members or more members.

Figure 12:
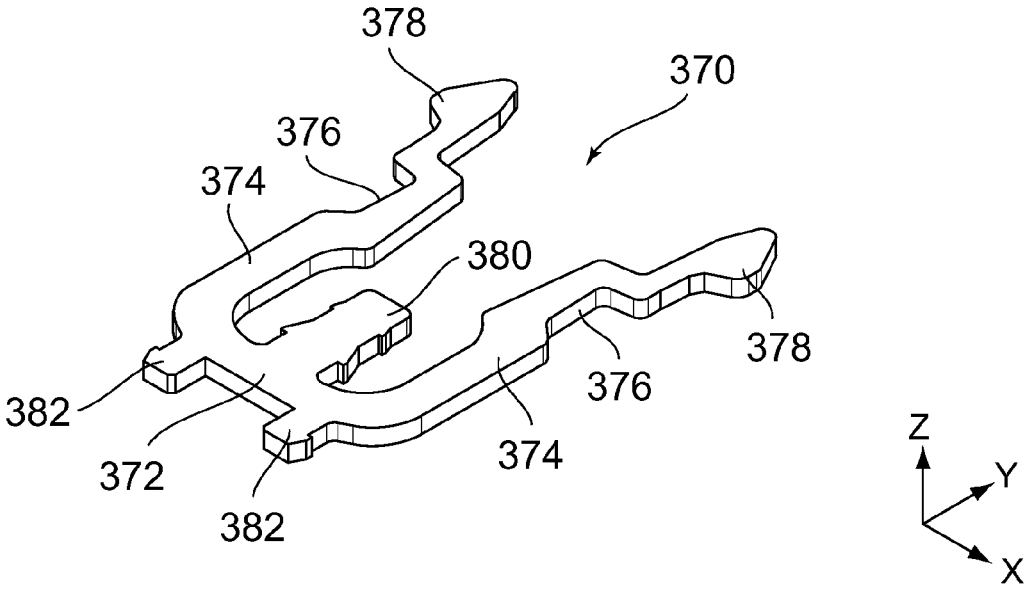
FIG. 12 is a perspective view showing a lock member of the second plug of FIG. 5.

As shown in FIGS. 6 and 12, the lock member 370 is formed by punching out a single metal sheet (base member) while not bending nor folding the base member. As shown in FIG. 6, this lock member 370 has a U-like shape including a base portion 372 and two arms 374. The arms 374 are located at opposite ends of the base portion 372 in the X-direction (lateral direction), respectively, and extend from the base portion 372 toward the plug mating end 310 along the positive Y-direction.

As shown in FIGS. 6 and 12, the arms 374 are resiliently deformable in the XY-plane. Each of the arms 374 is formed with a recess 376 recessed inward in the X-direction. Thus, the arm 374 has a meander shape. Because the recess 376 is provided, stress generated upon resilient deformation of the arm 374 can be prevented from being concentrated between the arm 374 and the base portion 372. Thus, the recess 376 has a function to relieve the stress generated upon the resilient deformation of the arm 374. The shape of the recess 376 of the arm 374 is not limited to the illustrated shape. The shape of the recess 376 may be a more rounded shape or a more angular shape, provided that the arm 374 meanders.

Each of the arms 374 has a second lock portion (lock portion) 378. The second lock portion 378 is provided in the vicinity of an end, or the positive Y-side end, of the arm 374. The second lock portions 378 protrude outward in the X-direction. The second lock portions 378 are supported by the arms 374, respectively, to be movable in the X-direction by the resilient deformation of the arms 374.

As shown in FIGS. 6 and 12, the lock member 370 according to the present embodiment is further provided with a press-fit portion 380 and two fixed portions 382.

As shown in FIG. 6, the press-fit portion 380 extends from the base portion 372 toward the plug mating end 310 along the positive Y-direction. The press-fit portion 380 is press-fit in and held by the outer member 364 of the plug holding-member 360. As can be seen from FIG. 6, the press-fit portion 380 is located at a middle portion of the base portion 372 in the X-direction. Moreover, the lock member 370 according to the present embodiment has a line-symmetrical shape with respect to an imaginary line which extends along the Y-direction through the middle point of the press-fit portion 380 in the X-direction. This lock member 370 has a so-called tuning fork structure so that secure lock can be realized in comparison with a case where the two lock portions 378 are provided to separated members, respectively.

As can be seen from FIGS. 6 and 7, the second plug-contact-portions 346 according to the present embodiment are located outward of the first plug-contact-portions 326 in the X-direction and located on the positive Y-side, or toward the plug mating end 310, in the Y-direction in comparison with the first plug-contact-portions 326. Accordingly, the second plug 300 is formed with a space that does not interfere with the first plug-contact-portions 326 and the second plug-contact-portions 346. This space is located on the negative Y-side, or a side further away from the plug mating end 310, in comparison with the second plug-contact-portions 346 and located outward of the first plug-contact-portions 326 in the X-direction. The lock member 370 according to the present embodiment is provided by using this space. Moreover, the lock member 370 is located toward the positive Z-side of the insert-molding member 362, or above the insert-molding member 362. Since the lock member 370 is located toward the positive Z-side of the insert-molding member 362, the lock member 370 is not brought into contact with the first plug-contact-portions 326 and the second plug-contact-portions 346. Moreover, since the lock member 370 is arranged by using the space that does not interfere with the first plug-contact-portions 326 and the second plug-contact-portions 346, the second lock portions 378 are located on the negative Y-side, or a side further away from the plug mating end 310, in comparison with the second plug-contact-portions 346 and located outward of the first plug-contact-portions 326 in the X-direction. Accordingly, even when the arms 374 are resiliently deformed, the lock member 370 is not brought into contact with the first plug-contact-portions 326 and the second plug-contact-portions 346.

As shown in FIG. 6, the fixed portions 382 extend from the base portion 372 and away from the plug mating end 310, or extend along the negative Y-direction. The fixed portions 382 are press-fit in and fixed to the cover member 366 of the plug holding-member 360. The fixed portions 382 have a function to combine the cover member 366 with the insert-molding member 362 and the outer member 364. Moreover, the fixed portions 382 have a function to prevent the lock member 370 from pivoting even in a case where the lock member 370 receives undesirable momentum in the XY-plane.

As can be seen from FIGS. 1 and 3 to 5, the plug shell 390 according to the present embodiment consists of two members. The plug shell 390 is attached to the plug holding-member 360 to cover the plug holding-member 360 by combining the two members with each other.

The second plug 300 having such structure is to be connected, for example, to a signal cable.

As described above, the lock member 370 according to the present embodiment has the press-fit portion 380 press-fit in the outer member 364 and the fixed portions 382 press-fit in the cover member 366. However, the lock member 370 may have only the press-fit portion 380 or only the fixed portions 382, provided that the lock member 370 is securely held by the plug holding-member 360.

As shown in FIGS. 13 to 16, the receptacle 500 according to the present embodiment comprises a plurality of first contacts 510 each made of a conductor, a plurality of second contacts 530 each made of a conductor, a holding member 550 made of an insulator and a shell 580 made of a metal.

Figure 17:
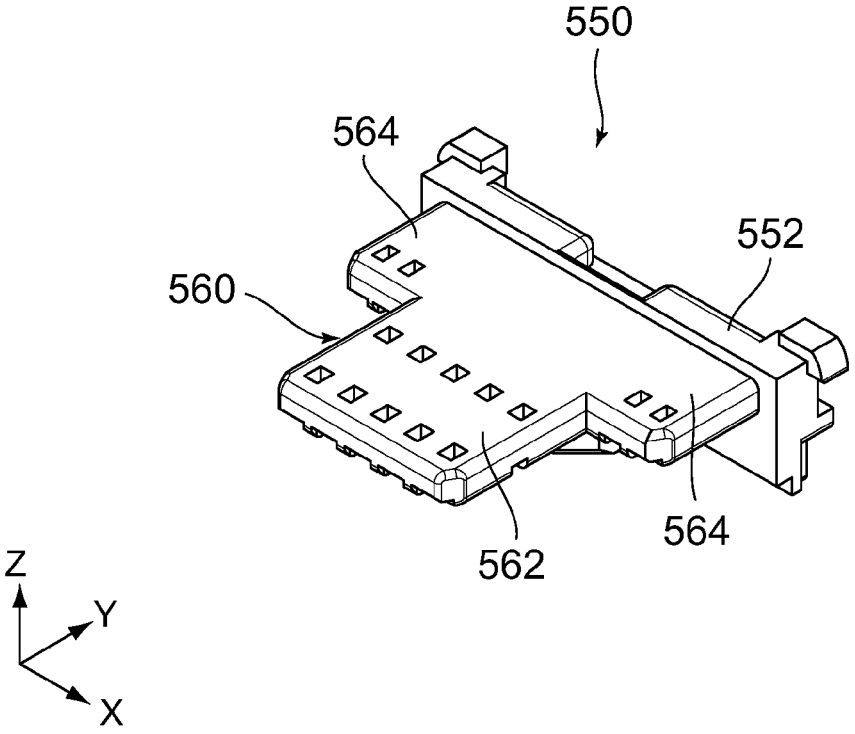
FIG. 17 is a perspective view showing the receptacle of FIG. 13 without its shell.
Figure 18:
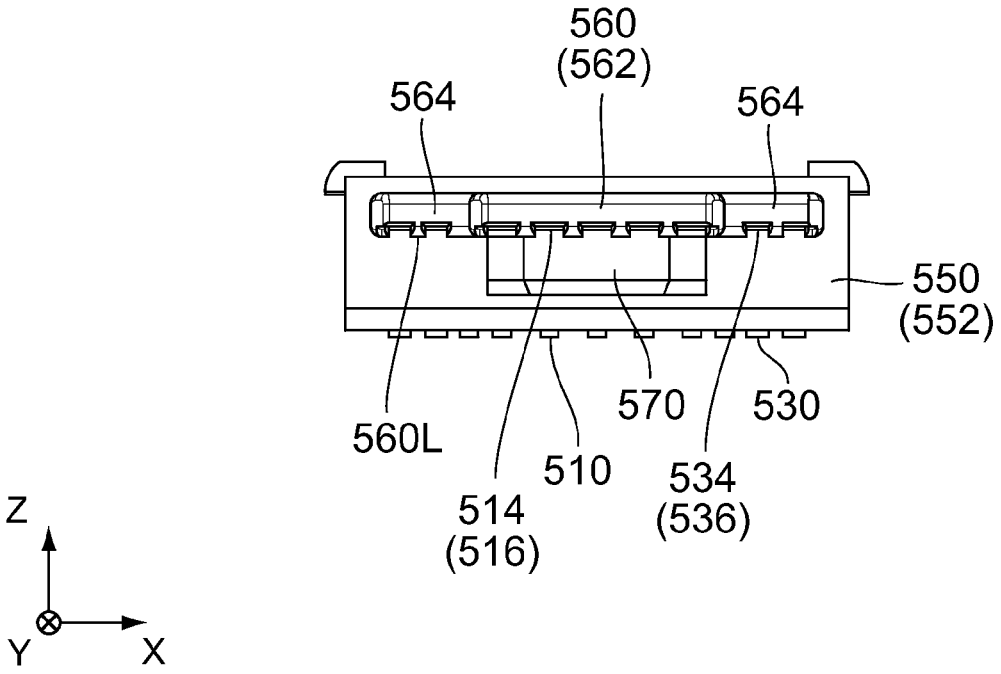
FIG. 18 is a front view showing the receptacle of FIG. 17.
Figure 19:
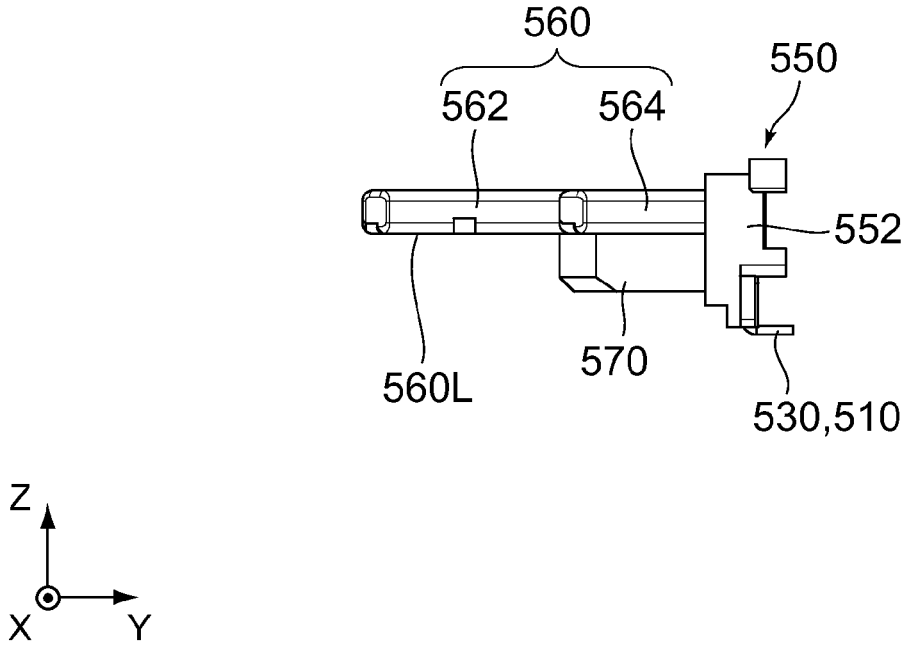
FIG. 19 is a side view showing the receptacle of FIG. 17.
Figure 20:
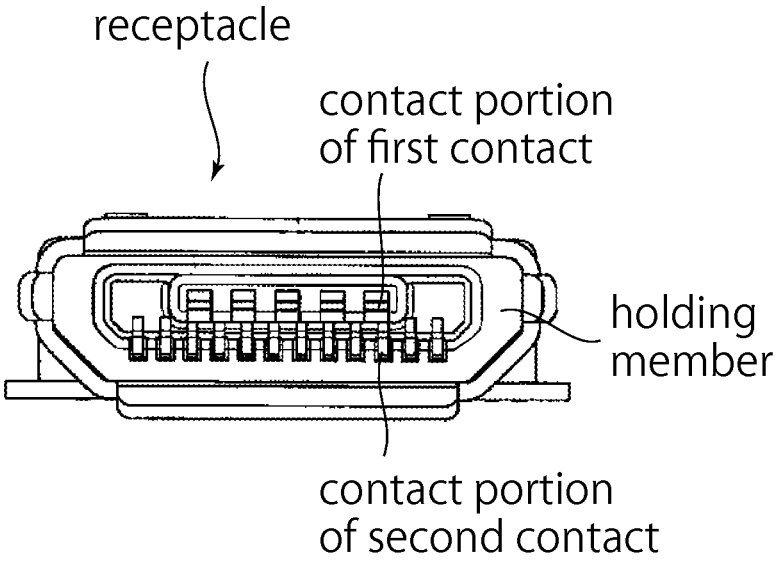
Fig. 20 PRIOR ART
FIG. 20 is a front view showing a receptacle of Patent Document 1.
Figure 21:
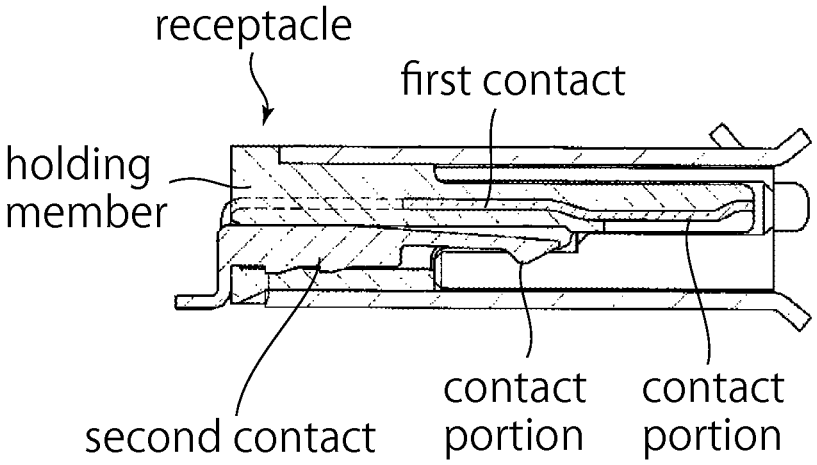
Fig. 21 PRIOR ART
FIG. 21 is a cross-sectional view showing the receptacle of FIG. 20.

As shown in FIGS. 17 to 19, the holding member 550 has a rear portion 552, a plate-like portion 560 and an abutment portion 570. The plate-like portion 560 extends forward along the negative Y-direction from the rear portion 552. The plate-like portion 560 has a lower surface 560L in the Z-direction (up-down direction). The abutment portion 570 is provided to be located toward the negative Z-side of the plate-like portion 560, or under the plate-like portion 560, and located toward the negative Y-side of the rear portion 552, or in front of the rear portion 552.

As best shown in FIG. 17, the plate-like portion 560 has a first portion 562 and two second portions 564. The abutment portion 570 is located under the first portion 562. As described later, the first portion 562 is a portion corresponding to the first contacts 510 while the second portions 564 are portions corresponding to the second contacts 530.

As apparent from FIG. 17, the first portion 562 and the second portions 564 extend forward along the negative Y-direction from the rear portion 552. In the Y-direction, the first portion 562 has a size larger than that of the second portion 564. In other words, the first portion 562 is longer than the second portion 564. The first portion 562 extends forward along the negative Y-direction beyond the second portions 564. The first portion 562 is sandwiched between the second portions 564 in the X-direction (lateral direction). As can be seen from these explanations, the plate-like portion 560 has a T-like shape in the XY-plane. As can be seen from FIGS. 18 and 19, the plate-like portion 560 according to the present embodiment has an almost uniform thickness or size in the Z-direction. However, the plate-like portion 560 may partially have a thick portion or a thin portion. Moreover, the plate-like portion 560 may have some steps.

As shown in FIG. 19, the negative Y-side end, or the front end, of the abutment portion 570 according to the present embodiment is located at a position same as a position of the negative Y-side end, or the front end, of the second portion 564. As can be seen from FIGS. 1, 2 and 19, when the receptacle 500 is mated with the first plug 100, the end 110 of the first plug 100 is brought into abutment with the abutment portion 570 to be stopped. Accordingly, the second portions 564 are guarded. Moreover, as described later, the second contacts 530 are provided at the second portions 564. Accordingly, the second contacts 530 are also guarded. The negative Y-side end, or the front end, of the abutment portion 570 may be located forward of the negative Y-side end, or the front end, of the second portion 564 in order to more securely guard the second portions 564 and the second contacts 530.

The number of the first contacts 510 is five. The first contacts 510 are connected to the first plug-contacts 320, respectively, when the second plug 300 is mated with the receptacle 500. Moreover, the first contacts 510 are connected to the respective contacts (not shown) corresponding to the first plug-contacts 320 when the first plug 100 is mated with the receptacle 500. In other words, the first contacts 510 correspond to the first plug-contacts 320. As can be seen from this explanation, the first contacts 510 are compliant with the USB 2.0 standard.

Figure 15:
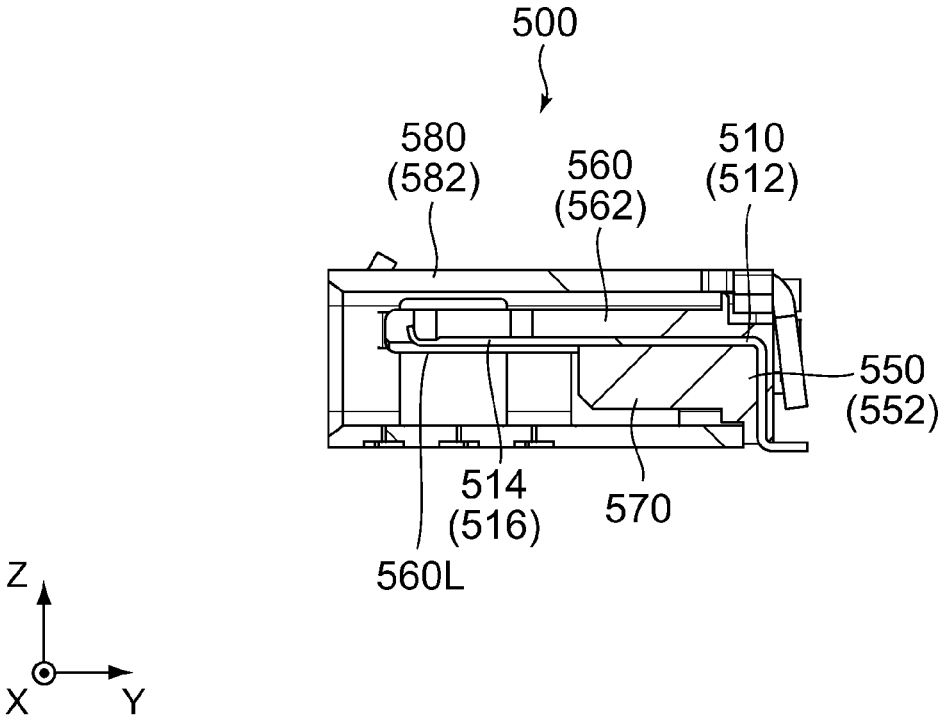
FIG. 15 is a cross-sectional view showing the receptacle of FIG. 13, taken along line XV-XV.

As shown in FIG. 15, each of the first contacts 510 has a first held portion 512 and a first extending portion 514. The first held portions 512 are held by the rear portion 552 of the holding member 550. The first extending portions 514 extend forward along the negative Y-direction directly from the first held portions 512, respectively. Each of the first extending portions 514 has a part that functions as a first contact portion 516. In other words, the first extending portion 514 is provided with the first contact portion 516. The first contact portion 516 is a part which is located on the negative Y-side in comparison with the abutment portion 570, or located forward of the abutment portion 570. The first contact portions 516 are connectable with both the first plug 100 and the second plug 300. In detail, the first contact portions 516 are brought into contact with the first plug-contact-portions 326 of the first plug-contacts 320, respectively, under the mated state of the receptacle 500 with the second plug 300. Similarly, the first contact portions 516 are brought into contact with the contact portions of the contacts corresponding to the first plug-contacts 320, respectively, under the mated state of the receptacle 500 with the first plug 100.

In the present embodiment, the first portion 562 corresponds to the first extending portions 514. The first contact portions 516 are exposed on the lower surface 560L of the first portion 562 of the plate-like portion 560 to be contactable. In the present embodiment, the first contact portion 516 has a strip-like shape extending in the XY-plane, and the first extending portion 514 does not have a spring property. Thus, the first contact portions 516 according to the present embodiment are neither deformed nor moved when the first contacts 510 are connected to the first plug-contacts 320 or the contacts (not shown) corresponding to the first plug-contacts 320.

The second contacts 530 are divided into two groups (sets) each of which includes two of the second contacts 530. The second contacts 530 are connected to the second plug-contacts 340, respectively, when the second plug 300 is mated with the receptacle 500. In other words, the second contacts 530 correspond to the second plug-contacts 340. As can be seen from this explanation, the second contacts 530 according to the present embodiment are used for transmitting high speed signals which satisfy the USB 3.0 specification. The first plug 100 is not provided with any contact corresponding to the second contact 530.

Figure 16:
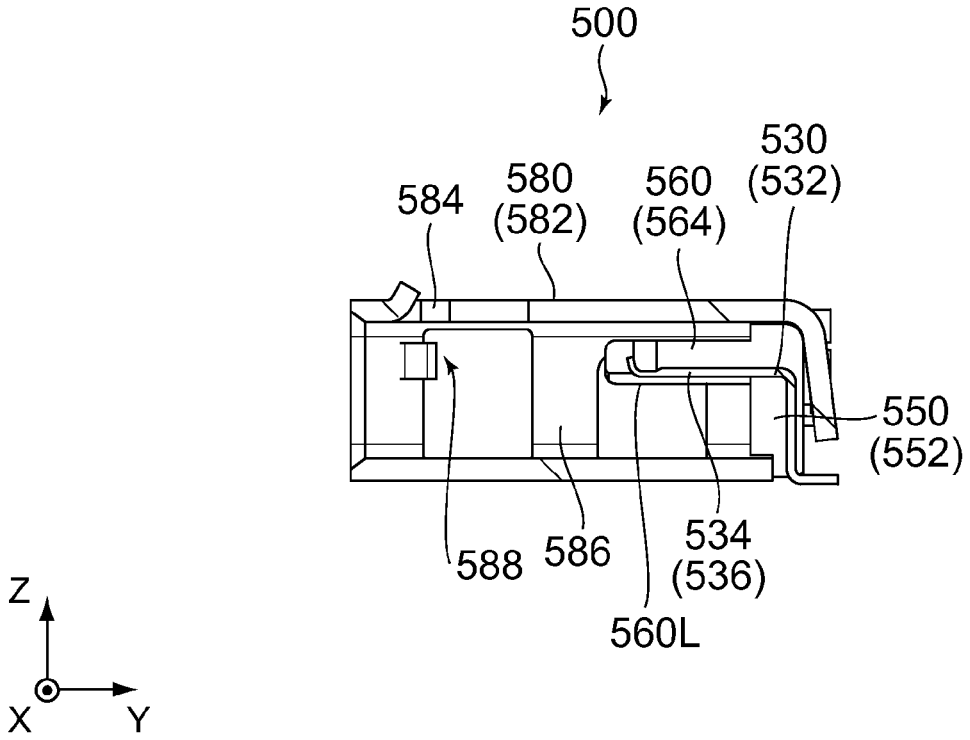
FIG. 16 is a cross-sectional view showing the receptacle of FIG. 13, taken along line XVI-XVI.

As shown in FIG. 16, each of the second contacts 530 has a second held portion 532 and a second extending portion 534. The second held portions 532 are held by the rear portion 552 of the holding member 550. The second extending portions 534 extend forward along the negative Y-direction directly from the first held portions 512, respectively. Almost all the parts of the second extending portion 534 function as a second contact portion 536. In other words, the second extending portion 534 is provided with the second contact portion 536. The second contact portions 536 are connectable with only the second plug 300 between the first plug 100 and the second plug 300. In detail, the second contact portions 536 are brought into contact with the second plug-contact-portions 346 of the second plug-contacts 340, respectively, under the mated state of the receptacle 500 with the second plug 300.

In the present embodiment, the second portions 564 corresponds to the second extending portions 534. The second contact portions 536 are exposed on the lower surfaces 560L of the second portions 564 of the plate-like portion 560 to be contactable. In the present embodiment, the second contact portion 536 has a strip-like shape extending in the XY-plane, and the second extending portion 534 does not have a spring property. Thus, the second contact portions 536 according to the present embodiment are neither deformed nor moved when the second contacts 530 are connected to the second plug-contacts 340 (for example, see FIG. 5). Generally, when a contact located at a rear side of a connector is required to have a spring property like that of Patent Document 1, the contact cannot avoid having a large size in a front-rear direction in order to obtain a sufficient spring property. Accordingly, a size of the connector in the front-rear direction cannot be reduced beyond a certain limitation. In contrast, according to the present embodiment, since the second contact 530 is not required to have a spring property, a size of the second extending portion 534 in the Y-direction (front-rear direction)

can be reduced. Thus, according to the present embodiment, a size of the receptacle 500 in the Y-direction (front-rear direction) can be reduced.

Figure 13:
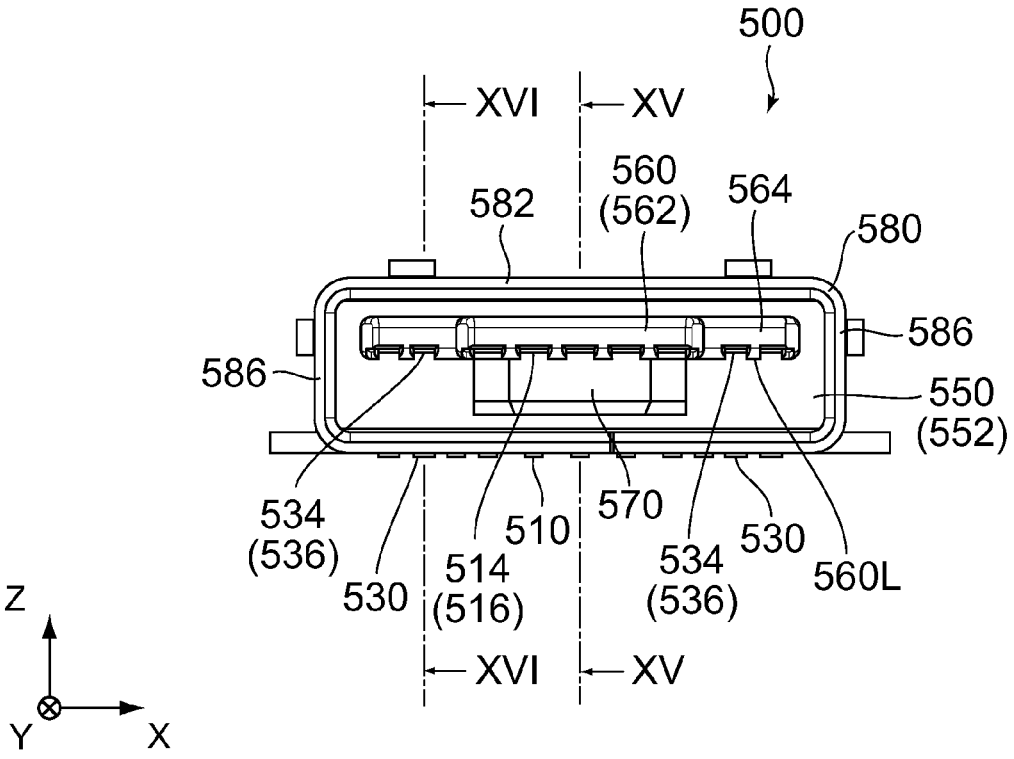
FIG. 13 is a front view showing the receptacle of FIG. 1.

As shown in FIG. 13, in the present embodiment, the first contact portions 516 and the second contact portions 536 are located in the common XY-plane. In other words, the first contact portions 516 and the second contact portions 536 are located at the same level as one another in the Z-direction. However, the present invention is not limited thereto. The first contact portions 516 may be located some distance apart from the second contact portions 536 in the Z-direction. However, when a size of the receptacle 500 in the Z-direction is required to be reduced, it is desirable that the first contact portions 516 and the second contact portions 536 are located in the common XY-plane like the present embodiment.

In the present embodiment, the first contact portions 516 are located toward the negative Y-side of the second contact portions 536, or forward of the second contact portions 536. Moreover, the second contact portions 536 are grouped into two groups (sets). The first contact portions 516 and the second contact portions 536 are arranged in the X-direction (lateral direction) so that the two second contact portions 536 of one of the groups (sets), the first contact portions 516 and the two second contact portions 536 of a remaining one of the groups (sets) are arranged in this order. In other words, in the X-direction (lateral direction), the first contact portions 516 are located between the two groups (sets) of the second contact portions 536. As described above, according to the present embodiment, the second contact portions 536, which form differential pairs for transmitting high speed signals which satisfy the USB 3.0 specification, are arranged to sandwich the first contact portions 516 which are compliant with the USB 2.0 standard. In comparison with an arrangement where contacts compliant with the USB 3.0 standard are simply arranged with contacts compliant with the USB 2.0 standard, this arrangement allows one of ground contacts to be omitted. Similar effect can also be obtained by the previously described arrangement of the first plug-contact-portions 326 and the second plug-contact-portions 346.

In the present embodiment, the first contacts 510 and the second contacts 530 are partially embedded into the holding member 550 via insert-molding when the holding member 550 is molded so that, as described above, the first held portions 512 and the second held portions 532 are held by the rear portion 552 of the holding member 550. However, the present invention is not limited thereto. For example, the first contacts 510 and the second contacts 530 may be press-fit into and held by the holding member 550. Even in this case, the first extending portion 514 and the second extending portion 534 are the portions that extend forward directly from the first held portion 512 and the second held portion 532, respectively.

According to the present embodiment, since the first contacts 510 and the second contacts 530 do not overlap each other in the Z-direction (up-down direction), the size of the receptacle 500 in the Z-direction (up-down direction) can be reduced.

Figure 14:
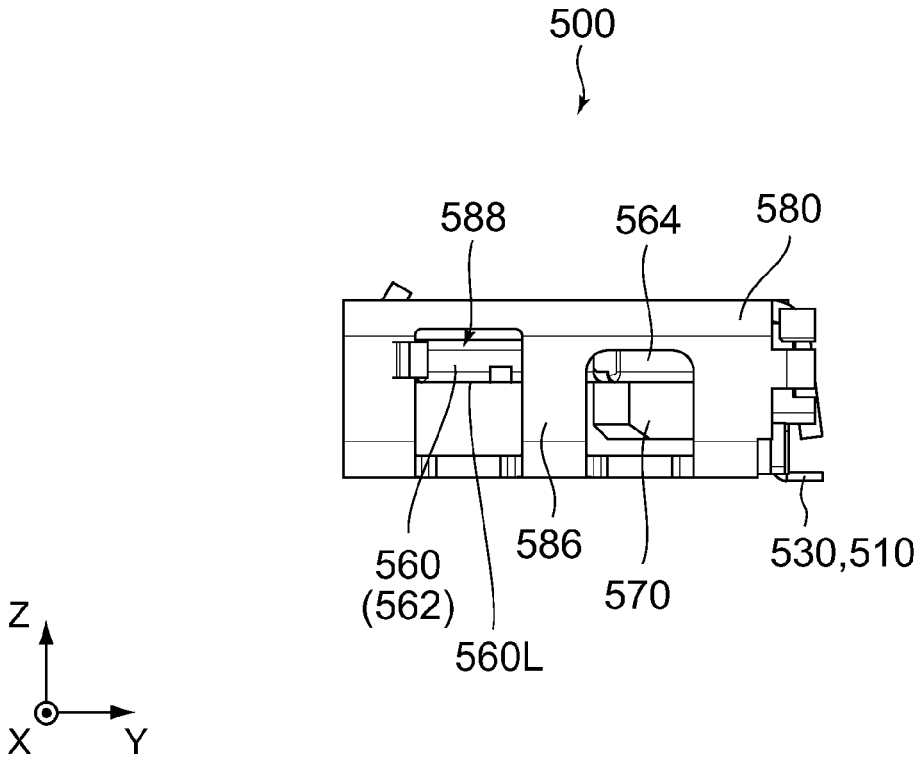
FIG. 14 is a side view showing the receptacle of FIG. 13.

As shown in FIGS. 1, 13 and 14, the shell 580 is formed to have a box-like shape including an upper portion 582 and two side portions 586. The shell 580 constitutes a receive portion for receiving a mating portion of the first plug 100 and the mating portion (plug mating end 310) of the second plug 300. The shell 580 covers, at least in part, the holding member 550. The shell 580 has two first locked portions 584 and two second locked portions 588. The first locked portions 584 are formed in the upper portion 582 of the shell 580 while the second locked portions 588 are formed in the side portions 586 of the shell 580, respectively. The first locked portions 584 can partially receive the first lock portions 120 of the first plug 100, respectively, while the second locked portions 588 can partially receive the second lock portions 378 of the second plug 300, respectively. In detail, the first locked portions 584 receive the first lock portions 120 to lock the mated state when the first plug 100 is mated with the receptacle 500. The second locked portions 588 receive the second lock portions 378 to lock the mated state when the second plug 300 is mated with the receptacle 500. Since the shell 580 according to the present embodiment is formed with the first locked portions 584 and the second locked portions 588, it is possible to lock the mated state in any case where any one of the first plug 100 and the second plug 300 is mated with the receptacle 500.

Although the above explanation is made specifically with the embodiment of the present invention, the present invention is not limited thereto. The present invention can be variously modified and applied.

For example, although any of the first contact 510 and the second contact 530 provided in the receptacle 500 does not have a spring property in the aforementioned embodiment, one of the first contact 510 and the second contact 530 may have a spring property.

Although the rear side of each of the first held portions 512 of the first contacts 510 and the second held portions 532 of the second contacts 530 is formed by bending to have a crank shape, the present invention is not limited thereto. For example, the rear side of each of the first held portions 512 and the second held portions 532 may extend straight rearward along the positive Y-direction.

Moreover, although each of the illustrated first contacts 510 and the illustrated second contacts 530 is a so-called surface mount technology (SMT) contact, each of the first contacts 510 and the second contacts 530 may be a through hole contact.

The receptacle 500 may be a straight connector that has a mating surface in parallel to a circuit board (not shown) where the receptacle 500 is mounted. Moreover, the receptacle 500 may be a drop-in connector that is to be arranged in a recess formed in the circuit board.

In the aforementioned embodiment, the first plug-contact 320 and the first contact 510 are compliant with the USB 2.0 standard. However, the present invention is not limited thereto. The first plug-contact 320 and the first contact 510 may be compliant with another standard or may be designed proprietarily.

In the aforementioned embodiment, the second plug-contact 340 and the second contact 530 are contacts for transmitting high speed signals which satisfy the USB 3.0 specification. However, the present invention is not limited thereto. The present invention can be applied to various usages.

The present application is based on a Japanese patent application of JP2013-080494 filed before the Japan Patent Office on Apr. 8, 2013, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A receptacle that is selectively mateable with one of a first plug and a second plug, the receptacle comprising:

a holding member having a rear portion and a plate-like portion, the plate-like portion extending forward in a front-rear direction from the rear portion, the plate-like portion having a lower surface in an up-down direction perpendicular to the front-rear direction;

a plurality of first contacts each of which has a first held portion and a first extending portion, the first held portions being held by the rear portion of the holding member, the first extending portions extending forward from the first held portions, respectively, each of the first extending portions being provided with a first contact portion, the first contact portions being exposed on the lower surface of the plate-like portion of the holding member to be contactable, the first contact portions being arranged at positions so as to be connectable with contacts of both the first plug and the second plug; and a plurality of second contacts each of which has a second held portion and a second extending portion, the second held portions being held by the rear portion of the holding member, the second extending portions extending forward from the second held portions, respectively, each of the second extending portions being provided with a second contact portion, the second contact portions being exposed on the lower surface of the plate-like portion of the holding member to be contactable, the second contact portions being arranged at positions so as to be connectable with only contacts of the second plug and not with contacts of the first plug, the first contact portions being located forward of the second contact portions, the second contact portions being grouped into two groups between which the first contact portions are located in a lateral direction perpendicular to both the front-rear direction and the up-down direction, wherein:

the first plug has a first lock portion;

the first lock portion protrudes upward in the up-down direction;

the second plug has a second lock portion;

the second lock portion protrudes outward in the lateral direction;

the receptacle further comprises a shell;

the shell covers, at least in part, the holding member;

the shell has a first locked portion and a second locked portion;

the first locked portion is configured to partially receive the first lock portion of the first plug in a state in which the receptacle is mated with the first plug; and the second locked portion is configured to partially receive the second lock portion of the second plug in a state in which the receptacle is mated with the second plug;

one of the first plug and the second plug has a lock member, the lock member comprising a base portion, two arms, and two lock portions, said two lock portions corresponding to one of the first lock portion and the second lock portion of the corresponding one of the first plug and the second plug;

the two arms extend from the base portion toward a plug mating end of the one of the first plug and the second plug;

the lock member has a press-fit portion;

the two arms are located at opposite ends of the base portion in the lateral direction, respectively;

the press-fit portion is located at a middle portion of the base portion in the lateral direction while extending from the base portion toward the plug mating end;

the press-fit portion is press-fit in a plug holding-member of the one of the first plug and the second plug;

the lock member is further provided with two fixed portions; and the fixed portions extend from the base portion and away from the plug mating end.

2. The receptacle as recited in claim 1, wherein:

the second contact portion has a strip-like shape extending in a plane defined by the front-rear direction and the lateral direction; and the second extending portion does not have a spring property.

3. The receptacle as recited in claim 1, wherein:

the plate-like portion has a first portion and two second portions;

the first portion corresponds to the first extending portions while the second portions correspond to the second extending portions;

the first portion extends forward beyond the second portions and is sandwiched between the second portions in the lateral direction;

the holding member is provided with an abutment portion;

the abutment portion is located under the first portion and in front of the rear portion;

a front end of the abutment portion is located forward of a front end of the second portion or is located at a same position as a position of the front end of the second portion in the front-rear direction; and in the state in which the receptacle is mated with the first plug, an end of the first plug abuts with the abutment portion to be stopped.

4. The receptacle as recited in claim 1, wherein the first contacts are compliant with a universal serial bus (USB) 2.0 standard.

5. A connector assembly comprising a plug and a receptacle, the receptacle being selectively mateable with one of the plug and another plug, wherein the receptacle comprises: (i) a holding member having a rear portion and a plate-like portion, the plate-like portion extending forward in a front-rear direction from the rear portion, the plate-like portion having a lower surface in an up-down direction perpendicular to the front-rear direction; (ii) a plurality of first contacts each of which has a first held portion and a first extending portion, the first held portions being held by the rear portion of the holding member, the first extending portions extending forward from the first held portions, respectively, each of the first extending portions being provided with a first contact portion, the first contact portions being exposed on the lower surface of the plate-like portion of the holding member to be contactable, the first contact portions being arranged at positions so as to be connectable with contacts of both the plug and said another plug; and (iii) a plurality of second contacts each of which has a second held portion and a second extending portion, the second held portions being held by the rear portion of the holding member, the second extending portions extending forward from the second held portions, respectively, each of the second extending portions being provided with a second contact portion, the second contact portions being exposed on the lower surface of the plate-like portion of the holding member to be contactable, the second contact portions being arranged at positions so as to be connectable with only contacts of the plug and not with contacts of said another plug, the first contact portions being located forward of the second contact portions, the second contact portions being grouped into two groups between which the first contact portions are located in a lateral direction perpendicular to both the front-rear direction and the up-down direction; and wherein:

the plug has a plug mating end that is receivable in the receptacle in a mated state in which the plug is mated with the receptacle;

the plug comprises a plug holding-member, and the contacts of the plug comprise a plurality of first plug-contacts and a plurality of second plug-contacts;

the plug holding-member holds the first plug-contacts and the second plug-contacts;

each of the first plug-contacts has a first plug-contact-portion;

the first plug-contact-portions are arranged to contact the first contact portions of the first contacts, respectively, in the mated state;

each of the second plug-contacts has a second plug-contact-portion;

the second plug-contact-portions are arranged to contact the second contact portions of the second contacts, respectively, in the mated state;

in the front-rear direction, a distance between the first plug-contact-portion and the plug mating end is longer than another distance between the second plug-contact-portion and the plug mating end;

the second plug-contacts are grouped into two groups;

in the lateral direction, the first plug-contact-portions are located between the second plug-contact-portions of the second plug-contacts of one of the two groups and the second plug-contact-portions of the second plug-contacts of a remaining one of the two groups, the plug further comprises a lock member;

the lock member is a planar metal sheet with no bends;

the lock member is held by the plug holding member;

the lock member has a base portion, two arms and two lock portions;

the arms extend from the base portion toward the plug mating end;

the lock portions are supported by the arms, respectively, to be movable in the lateral direction;

the lock member has a press-fit portion;

the arms are located at opposite ends of the base portion in the lateral direction, respectively;

the press-fit portion is located at a middle portion of the base portion in the lateral direction while extending from the base portion toward the plug mating end;

the press-fit portion is press-fit in the plug holding-member;

the lock member is further provided with two fixed portions;

the fixed portions extend from the base portion and away from the plug mating end; and the fixed portions are fixed to the plug holding-member.

6. The connector assembly as recited in claim 5, wherein each of the arms has a meander shape.

7. The connector assembly as recited in claim 5, wherein:

the plug holding-member has an insert-molding member;

the first plug-contacts and the second plug-contacts are embedded into the insert-molding member via insert-molding when the insert-molding member is molded; and the lock member is provided above the insert-molding member.

8. The connector assembly as recited in claim 5, wherein:

each of the second plug-contacts has a wide portion; and a width of the wide portion is equal to or more than twice of another width of the second plug-contact-portion.

9. The connector assembly as recited in claim 5, wherein the first plug-contacts are compliant with a universal serial bus (USB) 2.0 standard.

10. The connector assembly as recited in claim 5, wherein each of the two arms of the lock member is located within a space that is located on a side farther way from the plug mating end in comparison with the second plug-contact-portions and located outward of the first plug-contact-portions in the lateral direction.

* * * * *